US005124691A

United States Patent [19]

Sakamoto et al.

[11] Patent Number: 5,124,691

[45] Date of Patent: Jun. 23, 1992

[54] PICTURE INFORMATION DISPLAY DEVICE

[75] Inventors: Tatsuhiko Sakamoto, Yamatokooriyama; Toshimi Kiyohara, Nara, both of Japan

[73] Assignee: Sharp Kabushiki Kaisha, Osaka, Japan

[21] Appl. No.: 379,591

[22] Filed: Jul. 14, 1989

[30] Foreign Application Priority Data

Jul. 15, 1988 [JP] Japan ..... 63-177580

[51] Int. Cl.[5] ..... G09G 1/06

[52] U.S. Cl. ..... 340/721; 340/721; 340/723; 340/724

[58] Field of Search ..... 340/721, 724, 723, 726, 340/747

[56] References Cited

U.S. PATENT DOCUMENTS 4,618,858 10/1986 Belch ..... 340/724
4,686,521 8/1989 Beaven et al. ..... 340/703
4,872,001 10/1989 Netter ..... 340/721

OTHER PUBLICATIONS

"Graphic Bit-BLT Copy Under Mask" IBM Technical Disclosure Bulletin vol. 28 No. 6 Nov. 1985.

*Primary Examiner*—Alvin E. Oberley
*Assistant Examiner*—Doon Yue Chow

[57] ABSTRACT

A picture information display device for displaying at high speed a plurality of picture in windows in a display unit. A frame memory is used for storing the display information corresponding to a display surface of the display unit. There is a window memory for storing the picture information of the window. A control circuit outputs address signal corresponding to the scanning position of the display unit to the frame memory and window memory when the movement or scrolling of the window is detected that the window is moving condition the frame memory and window memory to output the display information and stored in the address represented by the address signal and the picture information in the moving window.

9 Claims, 4 Drawing Sheets

PICTURE INFORMATION DISPLAY DEVICE

BACKGROUND OF THE INVENTION

1. Field of the Invention

The present invention relates to a display device for displaying pictures in a form of multi-windows.

2. Description of the Prior Arts

A conventional multi-window picture display device is shown in FIG. 1. The device comprises a window memory 23 for-storing picture data to be displayed on the multi-window and a frame memory 22 for storing display data corresponding to picture elements of a CRT 21 acting as a display unit, whereby the picture data of the several windows read out from the window memory 23 are logically processed for the respective picture elements based on the registration signal by a raster operation unit (not shown) and the logically processed data is developed in the frame memory 22 as the display data, which are output to the CRT 21 synchronized with scanning timing signal so that the multi-windows A, B and C are displayed on the CRT 1 as shown in FIG. 1. In the example shown in FIG. 1, as a result of the logic operation of the windows A and B, the picture data of the window B is displayed and the result of the logical operation of the windows B and C is displayed as the picture data of the window C.

In the conventional device mentioned above, in order to display the picture data on the CRT 1, the content stored in the window memory 23 is subjected to the raster operation and the raster operated data is once developed in the frame memory 22. In turn the operated data is output to the CRT 1. Therefore, in case only the window C is moved to a separated area on the CRT 1, it is necessary to operate the raster operation on all of the contents in the windows A, B and C corresponding to the moving position and to develop the raster operated data in the frame memory 22, otherwise the windows can not be displayed on the CRT 1. Therefore, partly because the display output must be an indirect output, partly because non moved window A and B must be also operated by the raster operation, the multi-window display on the CRT 1 can not be performed with a high speed.

SUMMARY OF THE INVENTION

An essential object of the present invention is to provide a device which is able to display the picture in the multi-window form with a high speed.

In order to accomplish the above object, there is provided a picture information display device for displaying a plurality of pictures in windows in a display unit by reading out the picture information stored in a memory which comprises a frame memory for storing the display information corresponding to a display surface of the display unit, window memory means for storing the picture information of the window, detection means for detecting whether the window is in a moving condition on the display surface of the display unit, control circuit for outputting address signal corresponding to the scanning position of the display unit to the frame memory and window memory means when it is detected that the window is in a moving condition by the detecting means and causing the frame memory and window memory means to output the display information and stored in the address represented by the address signal and the picture information in the moving window, a raster operation circuit for performing logical operation to the display information and picture information, whereby the windows are displayed on the display surface with a high speed.

DETAILED DESCRIPTION OF THE PREFERRED EMBODIMENT

Figure 1:
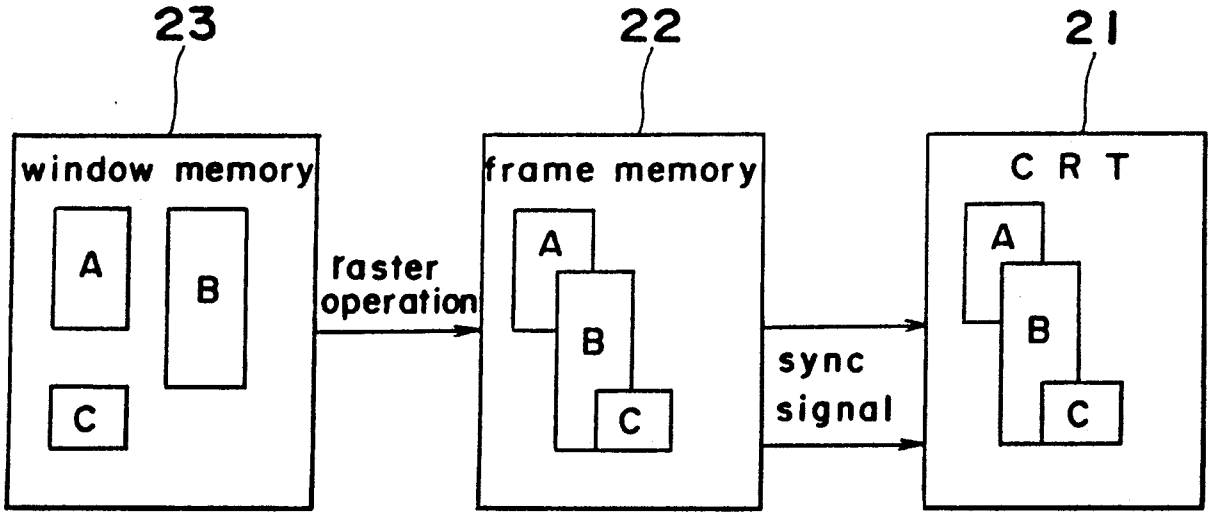
Fig. 1 (Prior Art)
FIG. 1 is a block diagram of a conventional picture display device.

Referring to FIG. 1, there are shown a cathode ray tube or CRT 2 as a display unit for displaying a picture, a frame memory 2 for storing picture data of the picture elements of CRT 1 and a window memory 3 for storing a plurality of picture data of windows A, B and C. A control device 4 acts to output the address signals $S_1$ and $S_2$ corresponding to the scanning position on the CRT 1 to the frame memory 3 and the window memory 4, causing the picture data Dw of the window which is brought into a moving condition and a display data Df stored in the addresses to be generated from the memories 2 and 3. A raster operation circuit 5 operates logic calculation on the display data Df and picture data Dw on the basis of the control signal $S_3$ and output a display output D to the CRT 1. The control circuit 4 is provided with a register 4*b* for storing window size and coordinate information of the respective windows A, B and C on the display plane of the CRT 1. The control circuit 4 calculates logic calculation of the picture registration for the respective picture elements of the window or windows except for the window or windows which are in the moving condition on the basis of the data stored in the register 4*b* and the window registration signal and the result of the calculation is transmitted to the frame memory 2 through the bus line 6. About the window or windows that are detected that the windows are brought into the moving condition, the control circuit 4 generates the address signal $S_2$ which corresponds to the scanning point of the CRT 1 on the basis of the data stored in the register 4*b*, sending the picture data stored in the address indicated by the address signal $S_2$ to the raster operation circuit 5. The address signal $S_1$ generated from the control circuit 4 to the frame memory 2 is a synchronizing signal of the scanning and is fed to the CRT 1. The control signal supplied to the raster operation circuit 5 is an instruction signal for instructing to pick up any one of the display data Df and the picture data Dw or calculate a logic sum "or" and "exclusive or" of the data Df and Dw about the respective picture elements. For example, assuming that the content of the window C is sent to the raster operation circuit 5 directly as the picture data Dw, the control signal is the instruction signal to pick up the picture data Dw.

Figure 3:
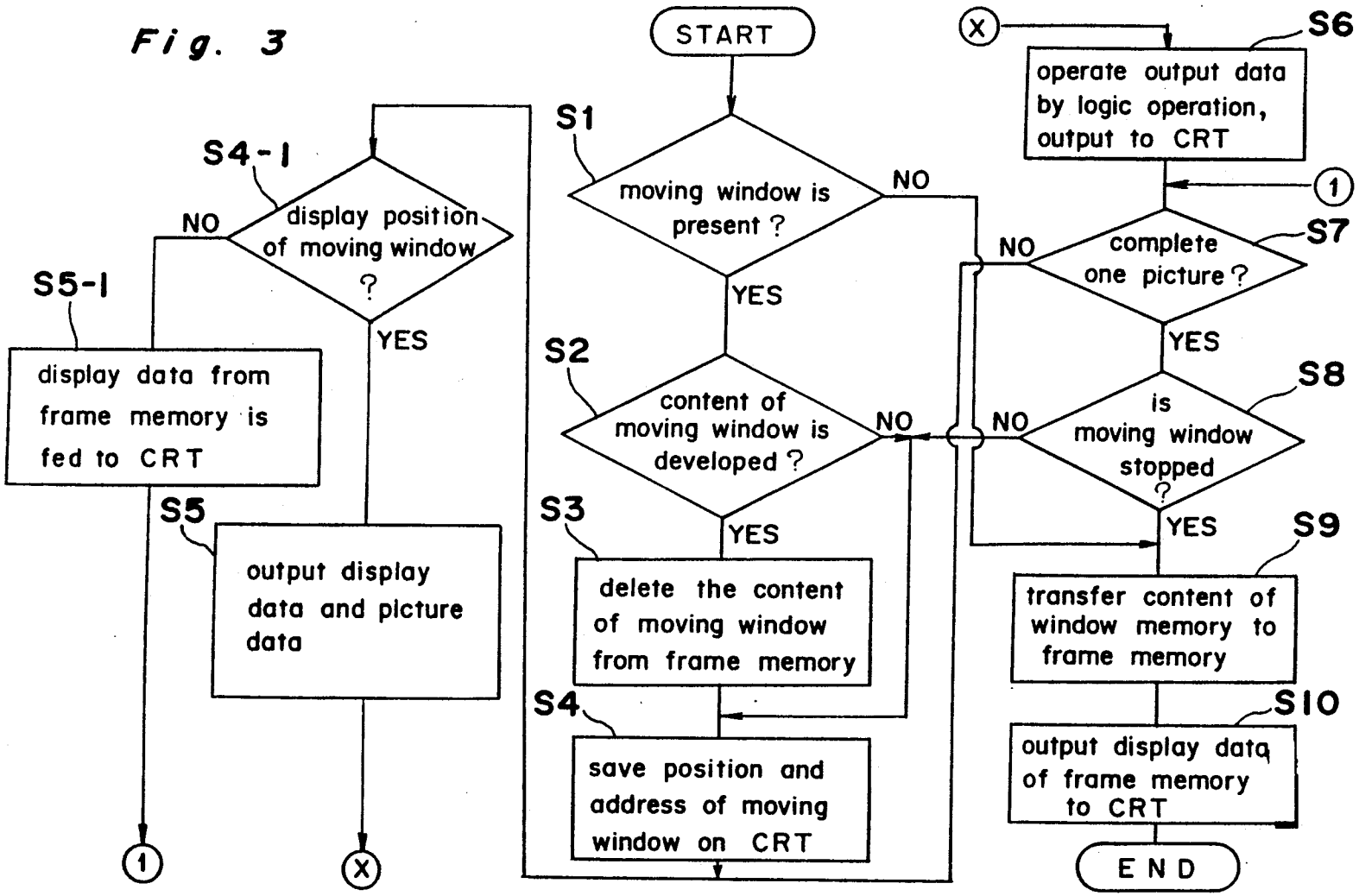
FIG. 3 is a flow chart showing an operation of the device shown in FIG. 2.

The operation of the device as mentioned above will be described with reference to FIG. 3.

It is assumed that the window C is brought into the moving condition in response to the window moving instruction from a key board (not shown). The detecting circuit 4a detects in the step S1 that the window C is in a moving condition, whereby the control circuit 4 performs the various processing steps after S2. It is judged in the step S2 that the content of the window C is developed in the frame memory 2 and if it is developed or with "yes", the program goes to the step S3 in which the content of the window C is deleted and the content of the window B is developed in the memory area where the content of the window C is already deleted, then the program goes to the step S4. If it is judged in the step S2 that the content of the window C is not developed, the program goes to the step S4 directly. It is noted that the process of the step S3 and the processes after steps S4 can be simultaneously parallelly performed since the data processed in the step S3 can be transferred through the bus 6 and the data processed in the other steps is transferred through other buses.

In the step S4, the coordinate data and the start address of the window C on the CRT 1 are saved in the register 4b in the control circuit 4 as the data signals $S_4$ and the program goes to the step S4-1. It is judged in the step S4-1 whether the present scanning position on the CRT is on the place where the window C is displayed, with "yes" the program goes to the step S5 wherein the control circuit 4 outputs the address signals $S_1$ and $S_2$ corresponding to the present scanning position to the frame memory 2 and the window memory 3, thereby causing the frame memory 2 and window memory 3 to output the display data Df and the picture data Dw of that address to the raster operation circuit 5.

In the step S6, the raster operation circuit 5 operates to the display data Df coming from the frame memory 2 and the picture data Dw of the window C coming from the window memory 3 the logical operation based on the logic signal $S_3$, whereby the result of the operation D is output to the CRT 1 as the data D for display. In the present embodiment, the logic operation mentioned above is made to pick up the picture data Dw of the window C.

In case the judgement in the step S4-1 is "no", the process in the step S5-1 is performed to output only the display data Df of the frame memory 2 directly to the CRT 1 through the raster operation circuit 5 without outputting the data Dw of the window memory 3.

After the process of the step S6 and S5-1 is finished, it is judged in the step S7 whether or not the CRT 1 finishes to scan the picture elements of one frame of picture, if the scanning of one picture has not yet been finished, the program goes back to the step S5 and the steps S6 to S8 are repeated until the processes for the end of one frame of picture is finished then the program goes to the sted S8 in which it is judged whether the window C is stopped by disappearing of the moving instruction. If the window is not stopped, the program goes back to the step S4 and repeats to process of the respective steps after the step S4, on the other hand, in case the window C is already stopped, the program goes to the step S9 wherein the content of the window C is transferred to the frame memory 2 as the picture data. When the respective windows are brought in the stopped condition, only the display data Df is transferred to the CRT 1 for display from the frame memory 2 through the raster operation circuit 5 without the direct picture data Dw from the window memory 3 in the step S10.

As mentioned above, in the present embodiment, the moving window which is in the moving condition such as move or scroll is detected by the detecting circuit 4a and the content of the window, which is in the moving condition, is directly output to the raster operation circuit 5 as the data Dw by the control circuit 4 having a high speed accessing ability, while the the content of the stopped window is changed to composite picture data by the control circuit 4 and the composite picture data is developed in the frame memory 2 then in turn transferred to the raster operation circuit 5 as the data Df. Both of the data Dw and Df are fed to the CRT 1 as the composite picture data D for display after logic operation in the circuit 5 by the control signal $S_3$. Therefore, it is possible to perform the multi-window display with the window movement on the CRT 1 without the raster operation with respect to the stopped window compared to the conventional way in which the data is output always through the frame memory 2.

Figure 4:
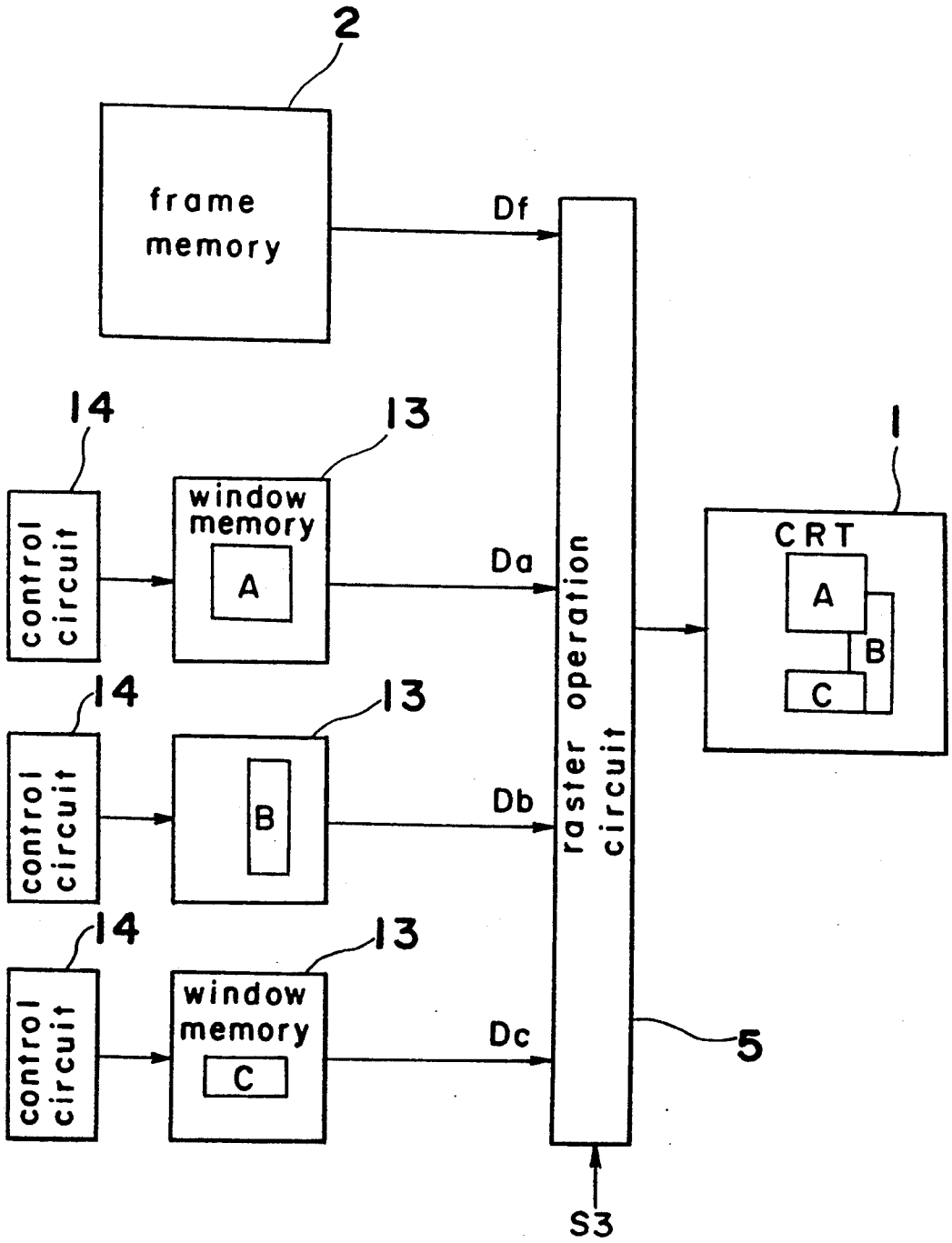
FIG. 4 is a block diagram showing a modification of the embodiment shown in FIG. 2.

FIG. 4 is a block diagram showing a modification of the embodiment of the picture information displaying device according to the present invention.

Figure 2:
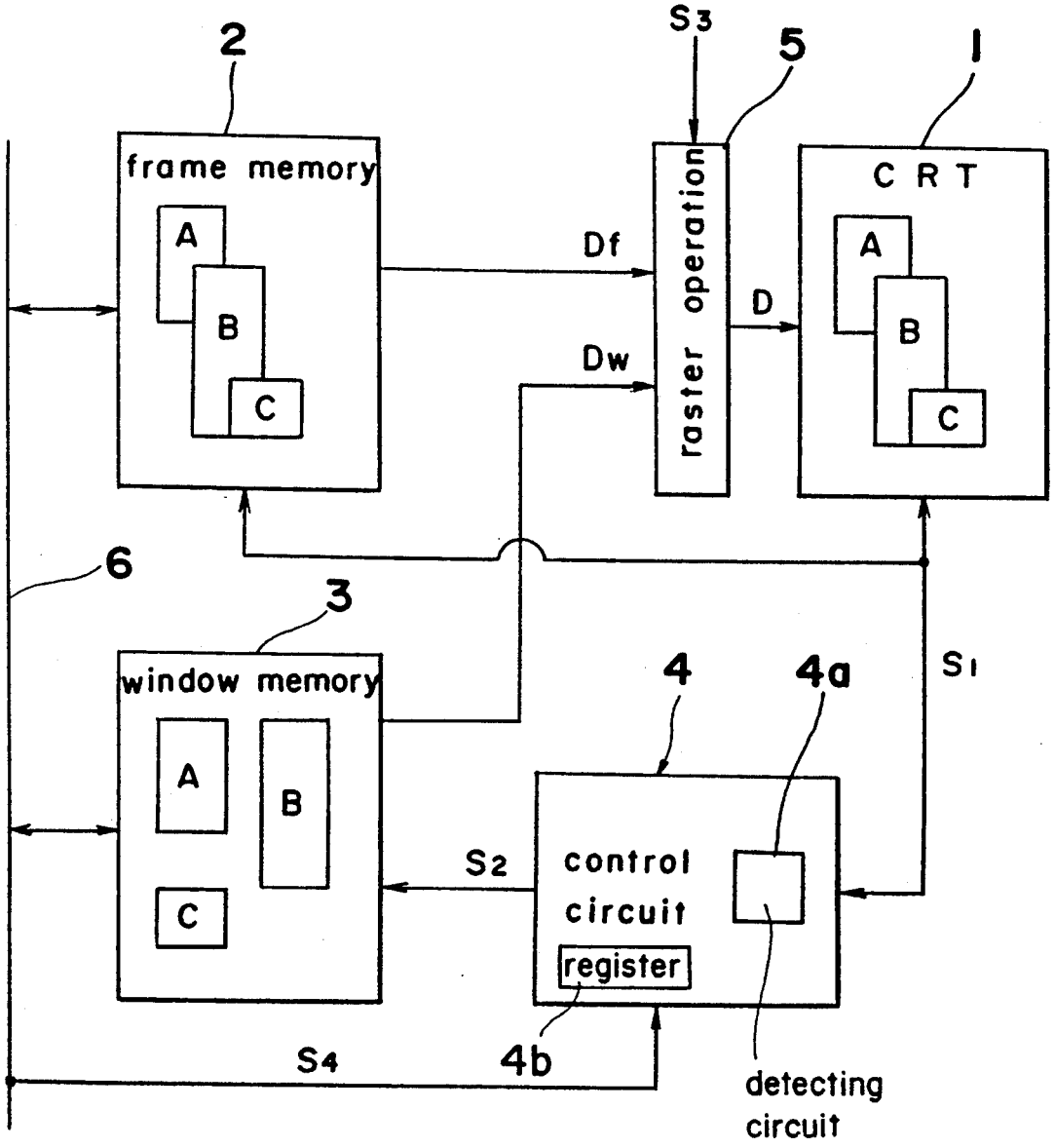
FIG. 2 is a block diagram showing an embodiment of a picture information device according to the present invention.

The device shown in FIG. 4 is substantially the same as the device shown in FIG. 2 except that there are provided window memories 13 and control circuits 14 with the same number of the displayed windows. The frame memory 2 and three control circuits 14 and window memories 13 for the windows A, B and C are coupled by bus lines (not shown). Each block operates in the same manner as mentioned above. Accordingly, each of the control circuits 14 controls the raster operation circuit 5 and frame memory 2 in the same manner as mentioned above. The raster operation circuit 5 performs the logic operation to the data Da, Db and Dc from each frame memory 13 and the data Df from the frame memory 2 based on the control signal $S_3$ then output the operated data to the CRT 1 for display.

According to the modification, since there are provided the same number of the window memories 13 and control circuits 14 as the number of the window, it is possible to display the windows on the CRT 1 with a high speed even if a plurality of the windows are brought into the moving condition.

What is claimed is:

1. A picture information display apparatus for displaying, at high speeds, a plurality of pictures in windows in a display unit by reading out the picture information stored in a memory which comprises:

a frame memory for storing display information data for displaying on a display surface of the display unit;

window memory means for storing picture information data of the window;

detection means for detecting whether the window is in a moving mode on the display surface of the display unit;

a control circuit for outputting address signals corresponding to a scanning position of the display unit to the frame memory and window memory means when the detecting means detects the window in the moving mode, resulting in the frame memory outputting display information data and the window memory means outputting picture information data, stored in the address represented by the address signals of both memories; and a raster operation circuit directly connected respectively to each of said window memory means and the frame memory for performing logical operation on said display information data and said picture information data, so as to output a display output on the display surface.

2. The apparatus of claim 1 wherein the display unit is a CRT.

3. The apparatus of claim 1 wherein there is only a single window memory means operatively connected to a single control circuit.

4. The apparatus of claim 3 wherein there are three window memories.

5. The apparatus of claim 3 wherein the display is a CRT.

6. The apparatus of claim 1, wherein the raster operation circuit performs logical calculation on the display information data and the picture information data in response to a control signal so that the output of the display is related to both of said data.

7. A picture information display apparatus for displaying from memory, pictures in a display unit at a high rate of speed comprising:

a frame memory for storing display information data for displaying on a surface of the display unit;

a plurality of window memories, each one of the window memories storing picture information data corresponding to a single window;

detection means for detecting whether a window is in a moving mode on a display surface of the display unit;

a plurality of control circuits, each one of the control circuits operatively connected to only one of said plurality of window memories, each control circuit outputting address signals corresponding to a scanning portion of the display unit to the frame memory and to its operatively connected window memory, when the detecting means detects a window in the moving mode, resulting in the frame memory outputting information data and a specific window memory outputting the display information data stored in the address represented by the address signals of said memories; and a raster operation circuit directly connected respectively to each of said window memories and frame memory for performing logical operation on said display information data and said picture information data so as to output a display on the display output surface.

8. The apparatus of claim 7 wherein there are three control circuits.

9. The apparatus of claim 7, wherein the raster operation circuit performs logical calculation on the display information data and the picture information data in response to a control signal so that the output of the display is related to both of said data.

* * * * *